US005593533A

United States Patent [19]

Groshens

[11] Patent Number: 5,593,533

[45] Date of Patent: Jan. 14, 1997

[54] THERMOBONDING INTERLINING COMPRISING A LAYER OF FIBERS INTERMINGLED WITH TEXTURED WEFT YARNS AND ITS PRODUCTION METHOD

[75] Inventor: Pierre Groshens, Peronne, France

[73] Assignee: Lainiere de Picardie S.A., France

[21] Appl. No.: 457,874

[22] Filed: Jun. 1, 1995

Related U.S. Application Data

[62] Division of Ser. No. 317,577, Oct. 4, 1994, Pat. No. 5,534, 330.

[30] Foreign Application Priority Data

Oct. 11, 1993 [FR] France ..... 93 12384

[51] Int. Cl.[6] ..... B05D 5/10; D04H 5/02

[52] U.S. Cl. ..... 156/305; 19/299; 28/105; 156/148; 427/208.2

[58] Field of Search ..... 156/305, 148, 156/177, 179, 291, 324; 427/207.1, 208.2; 28/104, 105; 19/299

[56] References Cited

U.S. PATENT DOCUMENTS

| | | | |
|---|---|---|---|
| 4,000,551 | 1/1977 | Holden . | |
| 4,172,172 | 10/1979 | Suzuki | 428/288 |
| 4,319,447 | 3/1982 | Barton . | |
| 4,450,196 | 5/1984 | Kamat | 156/148 |
| 4,737,396 | 4/1988 | Kamat | 156/148 |
| 5,153,056 | 10/1992 | Groshens | 428/286 |
| 5,171,309 | 12/1992 | Gallagher | 428/296 |
| 5,288,536 | 2/1994 | Zafiroglu | 428/299 |
| 5,437,918 | 8/1995 | Taniguchi | 428/288 |

FOREIGN PATENT DOCUMENTS

| | | |
|---|---|---|
| 0200385 | 12/1986 | European Pat. Off. . |
| 0363254 | 4/1990 | European Pat. Off. . |
| 0466563 | 1/1992 | European Pat. Off. . |
| 0501842 | 9/1992 | European Pat. Off. . |
| 2526818 | 11/1983 | France . |
| 2645180 | 10/1990 | France . |
| 1600768 | 10/1981 | United Kingdom . |

*Primary Examiner*—Daniel J. Stemmer
*Attorney, Agent, or Firm*—Ladas & Parry

[57] ABSTRACT

A method producing a thermobonding interlining comprises the steps of depositing a non-woven layer of intermingled fibers or filaments presented in a general direction on a conveyor of wire netting, directing toward said conveyor weft yarns made of textured continuous filaments that are kept in a stretched condition and parallel with one another; depositing the weft yarns in a zone where the non-woven layer is being deposited such that the weft yarns are oriented crosswise to the general direction of and covered by the non-woven layer. Afterwards, such superposed weft yarns and non-woven layer assembly is subject to the high pressure jets of water from injectors disposed above the conveyor so that the weft yarns and the fibers or filaments of the non-woven layer are intermingled to obtain a base material of interlining. Then, the base material of interlining is dried in a thermal treatment. The dots of thermofusible polymer are deposited one face of the base material of interlining.

4 Claims, 1 Drawing Sheet

THERMOBONDING INTERLINING COMPRISING A LAYER OF FIBERS INTERMINGLED WITH TEXTURED WEFT YARNS AND ITS PRODUCTION METHOD

This is a divisional of application Ser. No. 08/317,577 filed on Oct. 4, 1994 now U.S. Pat. No. 5,534,330.

FIELD OF THE INVENTION

The present invention is concerned with thermobonding interlining for garment pieces, constituted of an interlining base material on one face of which have been deposited dots of thermobonding polymer.

BACKGROUND OF THE INVENTION

Generally, the base materials for interlining, notably thermobonding interlining, are divided into two categories: specifically textile base materials and non-wovens. Specifically textile base materials are base materials which are obtained by weaving or knitting yarns, while the non-wovens are obtained by the constitution and consolidation of a layer of fibers or filaments.

Each one of these types of base materials presents advantages and disadvantages and it is up to the user to make a choice as a function of the properties required from the interlining.

Non-wovens are less expensive, but the fibers or filaments therein are irregularly distributed; as a result, not only can differences of density and surface irregulaties occur, but also an inadequate dimensional stability: the non-woven may be irreversibly deformed under the effect of stretching, which, in the case of a thermobonding interlining causes a poor stabilization of the garment piece on which the thermobonding interlining has been heat-bonded. Accordingly, despite their higher price, specifically textile base materials are preferred in those applications where the aforesaid disadvantages of non-wovens are redhibitory, the embodiment by weaving or knitting conferring to them the homogencity, in particular directionwise, which the non-wovens lack.

However, comparatively to non-wovens, specifically textile base materials are less voluminous and less plaisant to the feel.

Attempts have already been made to find a base material for interlining which has both the volume and the feel of a non-woven and the properties of cohesion, springiness and non-stretching of the woven or knitted base material.

This is obtained, in document FR.2 645 180, by juxtaposing a knitted or woven textile base and at least a non-woven layer, and by bonding these two elements by needling using jets of fluid.

The main disadvantage of this composite intended for interlining resides in its production cost which combines the cost of a knitting or of a fabric with that of a non-woven.

SUMMARY OF THE INVENTION

It is the aim of the Applicant to provide a thermobonding interlining of which the base material has the required characteristics, and which regroups the properties of specifically textile base materials and of non-wovens, without the disadvantages of high production costs. The aim is also to find a base material with sufficient elasticity for the thermobonding interlining to retain its ability to adopt to all the shapes given to the garment.

This object is reached perfectly by the thermobonding interlining according to the invention, which interlining is constituted in known manner of at least one non-woven layer of intermingled fibers or filaments, of given general direction and of which one face is covered with dots of thermofusible polymer. In characteristic manner, it comprises yarns called weft yarns which are continuous yarns of textured filament and which are disposed crosswise with respect to said general direction, while being bonded to said layer due to the intermingling of the fibers or of the filaments of the layer.

Contrary to the composite described and claimed in document FR.2 645 180, the base material for interlinging according to the invention does not comprise a knitting or a fabric but only weft yarns which are arranged so as to be parallel together and which are fast with the non-woven layer due to the intermingling of the yarns or filaments constituting same.

The weft yarns confer to the base material according to the invention a dimensional stability in transversal direction which is comparable to that of a woven textile base or of a weft knitted fabric. In longitudinal direction, the cohesion of the base material is comparable to that of a non-woven, but it should be noted that in the field of interlining, it is mostly the stability and strength in transversal direction which is sought; therefore this does not constitute a particular disadvantage.

Moreover, the weft yarns are yarns of textured continuous filaments. On the one hand, the presence of the crimping caused by texturing confers to the non-woven layer, the ability to stretch crosswise which is required for a thermobonding interlining expected to adopt the forms given to the garment piece which it reinforces. Said ability to stretch should give an elasticity in weft direction of at least several percents, ranging for example between 5% and much higher values such as 20%.

On the other hand, the presence of the crimping caused by texturing improves the fastening of the fibers or filaments of the non-woven layer with the weft yarns. This is further improved in the case of textured yarns with high voluminosity, obtained by the texturing technique using jets of air, from at least two multifilament yarns, a first yarn called core yarn and a second yarn called effect yarn.

Indeed in this type of textured yarn, the effect yarn produces loops around the core yarn, in which loops are caught up the fibers or filaments of the non-woven layer.

In a first version, the thermobonding interlining of the invention is constituted of only one non-woven layer of intermingled fibers or filaments, the weft yarns being partly exposed on one face of said layer; moreover, the dots of thermofusible polymer are disposed on said face.

As a result of the application of the dots of thermobonding polymer, the polymer locally ensures the cohesion of the elements with which it is in contact; in the present case, it can be the fibers or filaments of the non-woven layer, among which the fibers or filaments making up the intermingling of weft yarns, as well as the textured continuous yarns forming the weft. An improved cohesion is thus obtained between the weft yarns and the non-woven layer, which cohesion is ensured not only by the intermingling of the fibers or filaments of the layer and of the weft yarns, but also by the bonding of the latter due to the dots of thermofusible polymer.

The increased cohesion resulting from the bonding by the polymer, makes it possible to correlatively reduce the intermingling action when this is liable to cause a damaging effect. For example, when the intermingling of the fibers or filaments of the non-woven layer is obtained by the action of high pressure jets of fluid, it has been found that such action tends to compress the layer, namely that it makes it lose volume. This can be a problem for certain thermobonding interlining applications. Similarly, the action of the high pressure jets of fluid tends to alter the bulk of the base material, making it drier. Thus, in the first example of embodiment of the invention, it is possible to substantially reduce the action of the jets of fluid, due to the added cohesion brought by dots of thermobonding polymer deposited on the face of the layer where the weft yarns are partly exposed, so as to obtain a thermobonding interlining having good characteristics of bulk and voluminosity. This increased cohesion due to the polymer is particularly sensitive when the density of the weft yarns is equal to or greater than 3 yarns/cm.

According to a second embodiment, the thermobinding interlining of the invention comprises two non-woven layers disposed on either side of the weft yarns. The weft yarns are sandwiched between the two layers and are bonded thereto due to the intermingling of the fibers or filaments of said two layers.

This second embodiment is particularly called for to obtain a coating surface for depositing the dots of thermofusible polymer, which is the flattest and most regular possible, in the case of a fine coating, i.e. a coating which comprises a number of dots of polymer per square centimeter which is around or higher than 60.

Preferably, in this case, the second non-woven layer on which the dots of thermofusible polymer are deposited has a basis weight lower than that of the first layer. Taking for example a thermobonding interlining for a light weight garment, and knowing that the interlining has a basis weight of between 50 and 65 g/m$^2$, the second non-woven layer must have a basis weight of 10 to 20 g/m$^2$, and the first layer a basis weight of 25 to 35 g/m$^2$.

Advantageously, the yarns used for producing the weft yarns are shrinkable textured yarns, and the intermingling of the fibers or filaments of the non-woven layer or optionally layers is obtained by the action of high pressure jets of fluid; in this case, the base material for interlining has undergone, after the action of the jets of fluid, a heat-shrinkage treatment. The advantage of this being to further increase the voluminosity of the thermobinding interlining.

BRIEF DESCRIPTION OF THE DRAWINGS

The invention will be more readily understood on reading the following description of one example of embodiment of a thermobonding interlining comprising a non-woven layer of fibers or filaments intermingled with weft yarns constituted by yarns of continuous textured filaments, illustrated by the accompanying drawing, in which.

DETAILED DESCRIPTION OF PREFERRED EMBODIMENTS

Figure 3:
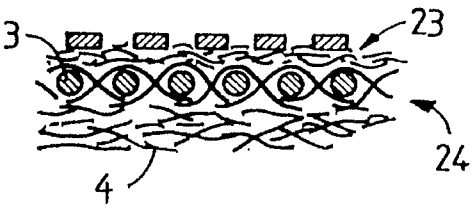
FIG. 3 is a diagrammatical cross-sectional illustration of a thermobinding interlining having two non-woven layers.
Figure 1:
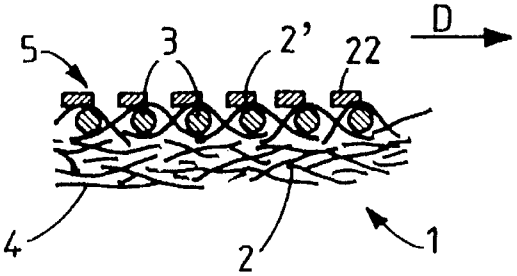
FIG. 1 is a diagrammatical cross-sectional view illustrating a thermobonding interlining having only one non-woven layer.

The thermobinding interlining 1, according to the invention, comprises a non-woven layer of fibers 2 intermingled with one another and with yarns 3, called weft yarns, which are arranged crosswise with respect to the general direction D of the layer 4.

According to the invention, the weft yarns 3 are yarns made of continuous textured filaments and are bonded together solely by the intermingling of the fibers 2 which constitute the non-woven layer 4.

The number of weft yarns 3 is at least 3 yarns per centimeter and the dots 22 of thermofusible polymer are deposited on the face 5 of the layer 4 whereupon the weft yarns 3 are those that are more exposed. A stronger cohesion of the weft yarns and of the non-woven layer is thus obtained, which stronger cohesion is due to the fact that, added to the intermingling of the fibers 2' around the weft yarns 3, there is a superficial bonding of certain fibers 2 and of certain weft yarns by the polymer of the dots 22.

Figure 2:
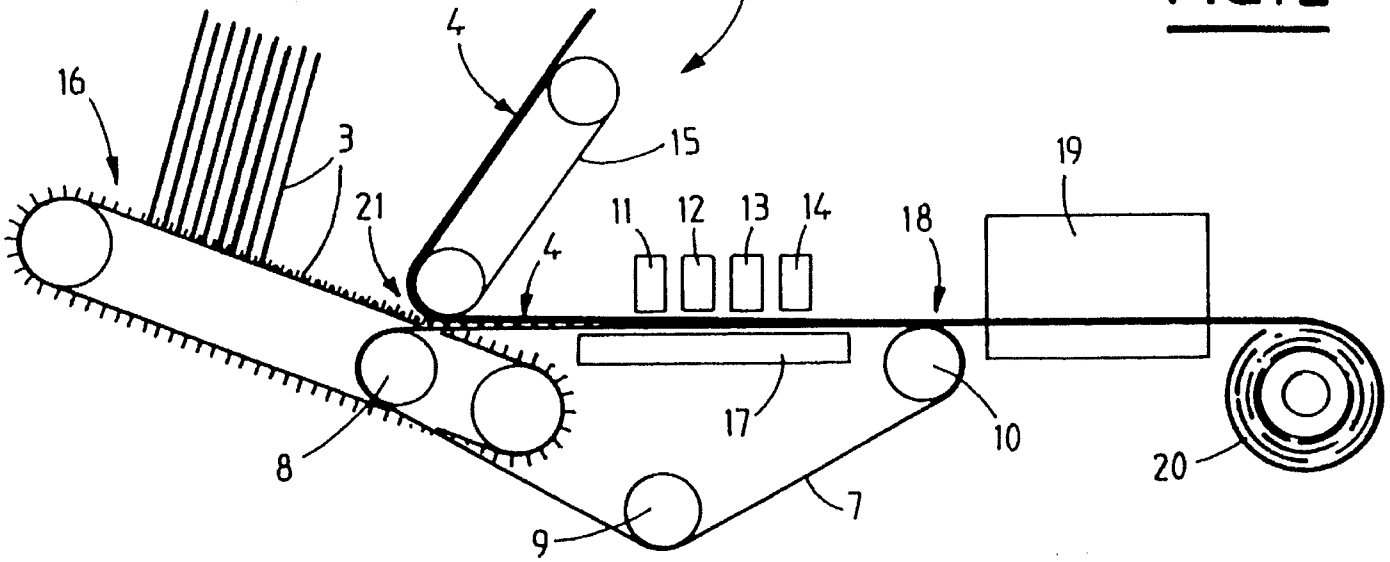
FIG. 2 is a diagrammatical lateral illustration of the installation for bonding the non-woven layer with the weft yarns by the action of jets of fluid.

The base material 18 for interlining is produced in a bonding installation using jets of fluid, such as that illustrated in FIG. 2.

This installation 6 comprises a conveyor belt 7, which is a wire netting stretched between three drams 8, 9 and 10, drum 10 being driven in rotation by means not shown. Above the upper side of the conveyor belt 7, are provided ramps of injectors which are fed under high pressure. FIG. 2 shows four ramps 11, 12, 13, 14, fed for example under pressures respectively equal to 40 bars for the first injector 11, 60 bars for the second injector 12, 70 bars for the third injector 13 and 80 bars for the fourth injector 14.

The conveyor belt 7 is preceded by two supply assemblies. The first assembly 15 is a second conveyor belt on which the non-woven layer 4 constituted of fibers 2 has been formed by any appropriate and conventional means. The fibers 2 reach the second conveyor belt 15 in the form of a layer which has no cohesion but which is held in position by suction.

As clearly shown in FIG. 2, the second belt 15 is disposed obliquely, above the first belt 7, at the level of the input drum 8.

The second supply assembly 16 is constituted of a mobile yarn lapping system equipped with clamps or hooks, capable of receiving and stopping the two ends of the lengths of yarn 3 which are fed by means not shown, and of keeping them in stretched condition, parallel to one another and of directing them towards the first belt 7 in the zone 21 thereof in which zone the second layer 4 of fibers or filaments is deposited by the second belt 15. It is possible to adjust the density of the yarns 3 for a given length of layer 4 as a function of the relative speeds of the second assembly 16 and of the first belt 7.

In the illustrated example, the layer 4 is placed above the yarns 3.

The assembly constituted of the superposition of the yarns 3 and of the layer 4 of fibers or filaments 2 passes successively under the four injectors 11, 12, 13, 14. The water which is projected by said injectors not only attacks directly the fibers or filaments 2, it also bounces on the metal screen constituting the belt 7, and in doing so it moves the fibers or filaments 2 of the layer 4 one with respect to the other. The bulk and the diameter of the wires which constitute the netting are so selected as to ensure the best intermingling efficiency when the layer 4 passes under the ramps of injectors 11 to 14. In this particular embodiment, the diameter of the wires is 0.5 mm and the netting has an aperture of 30, which means that the gaps between the meshes of the netting represent 30% of the total surface of the latter.

The water issued from the injectors 11 to 14 is collected in a suction box 17 which is placed under the upper side of the belt 7 perpendicularly to the ramps of injectors 11 to 14. Said water is recycled by a set of pumps, not shown.

In the base material for interlining 18 which is constituted by the layer 4 and by the yarns 3, the fibers or filaments 2 are intermingled together in such a way as to ensure cohesion of said layer 4, but they are also intermingled around the yarns 3, called weft yarns.

This assembly 18 consolidated as indicated, penetrates into a drying and optionally thermobonding tunnel 19, controlled, for example, to between 110° C. and 180° C., after what it is wound to form a bobbin 20.

Then the base material for interlining 18 is coated with dots of a thermobinding resin. Said dots are deposited on the face 5 of the base material 18 on which the weft yarns 3 are the most exposed. In the example illustrated in FIG. 2, this face is the one which is turned towards the first belt 7.

The dots of resin are deposited by means of engraved cylinders, the resin being deposited either in paste form 5 (screen-printing cylinder) or in powder form (heliogravure type engraved cylinder). It can also be performed by means of a perforated cylinder of printing type in which the paste is fed inside the cylinder and then pushed out of the cylinder through the perforations by a scraper. The base material 18 on which the dots of resin are deposited is then passed through a drying tunnel.

According to one specific embodiment, the fibers 2 arc polyester fibers of 1.5 dtex; the layer 4 has a basis weight of 25 g/m$^2$, the weft yarns arc falsetwist textured yarns of polyester of 100 dtex, disposed on the layer 4 at the rate of six yarns per cm. The thermobonding resin is in polyamide paste form; it is deposited by means of a printing type perforated cylinder having about 40 holes per cm$^2$. The diameter of each perforation being about 0.6 mm.

The thermobonding interlining thus obtained has the qualities of voluminosity and the fed of a non-woven, as well as the characteristics of dynamometrics and dimensional stability of a base material of the fabric type or of the weft knitted type. In particular, an increase of the dynamometrics resistance of the base material 18 has been noted after the application of the dots of resin, due to the bonding of the fibers 2' with the weft yarns 3, which fibers, by being intermingled with the weft yarns 3, happen to be on the surface of the base material 18.

FIG. 2 shows an installation 6 in which the action of the water jets is applied only on one face of the base material 18. Preferably, the installation used is one with at least two sets of ramps of injectors acting respectively on the two faces of the base material in order to improve the intermingling of the fibers 2 around the weft yarns 3. The second set of ramps of injectors, although not shown, can be understood as being disposed below the conveyor belt 7.

FIG. 2 also shows an installation 6 in which only one layer is fed. Said installation can easily include a third feeding assembly for a second layer 23, as shown in FIG. 3 which is deposited on the first belt 7 perpendicularly to the input dram 8 before zone 21. In this case, the weft yarns 3 are disposed between the two layers 4 and 23, before the assembly passes under the injectors. In the obtained base material for interlining, the weft yarns 3 are sandwiched between the two layers 4, 23 of which the fibers or filaments 2 are intermingled with one another and around the weft yarns 3.

This variant of interlining 24 as shown in FIG. 3 with two non-woven layers 4, 23 is particularly advantageous to use when the coating of thermobonding resin is a fine one, meaning that it has a number of dots per cm$^2$ which is equal to or higher than 60, which imposes that the surface to be coated be perfectly flat and even. Preferably, in this case, a second non-woven layer 23, lighter than the first 5, is used. In one specific example of interlining for a lighter garment, of basis weight between 50 and 65 g/m$^2$, the coating is between 12 and 14 g/m$^2$, the weft yarns between 5 and 6 g/m$^2$, a first layer between 25 and 35 g/m$^2$ and a second layer between 10 and 20 g/m$^2$.

The weft yarns 3 being textured yarns, an excellent catching and intermingling effect is obtained thanks to the natural crimping of said yarns. Said textured yarns can be of the set falsetwist type but preferably they are high voluminosity textured yarns obtained by the air jet texturing technique starting with at least two multifilament yarns, namely a first yarns called core, yarn and a second yarn called effect yarn, the overfeeding of the effect yarn being clearly higher than that of the core yarn. Said high voluminosity textured yarns have a texturing in loop form which further helps the intermingling with the fibers or filaments 2 during the action of the jets of fluid.

The weft yarns 3 may also be shrinkable textured yarns. In this case, the shrinking of the weft yarns occurs in the drying oven 19 or during a subsequent operation. The shrinking of the yarns 3 makes it possible to further increase the voluminosity of the base material 18 and to obtain a greater elasticity of said base material 18 in crosswise direction.

The layer may be constituted of any type of continuous fibers and filaments, including those of the spun or melt-blown type.

What is claimed is:

1. A method of producing a thermobonding interlining having a non-woven layer of intermingled fibers or filaments and dots of thermofusible polymer deposited on one face of the non-woven layer, said method comprising the steps of depositing a non-woven layer of intermingled fibers or filaments on a conveyor constituted of a wire netting, said fibers or filaments oriented generally in a single direction; directing toward said conveyor weft yarns that are made of textured continuous filaments and kept in a stretched condition and parallel with one another; depositing said weft yarns on the conveyor in a zone where the non-woven layer is being deposited such that the weft yarns are oriented crosswise to the direction of the non-woven layer and covered by the non-woven layer to form an assembly; subjecting the assembly of the weft yarns and the non-woven layer to high pressure jets of water from injectors disposed above the wire netting conveyor so that the fibers or filaments of the non-woven layer are intermingled with the weft yarns; subsequently subjecting said assembly to a drying treatment to obtain a base material of interlining; and depositing dots of thermofusible polymer on one of two faces of the base material to obtain the thermobonding interlining.

2. The method of claim 1, including the steps of providing the weft yarns as shrinkable textured yarns and shrinking the weft yarns.

3. The method of claim 2, wherein the shrinking of the weft yarns is made at the same time of the drying treatment.

4. The method of claim 1, wherein the dots of the thermofusible polymer are deposited on the face of the base material that was in contact with the wire netting conveyor before the drying treatment.

* * * * *